US008698861B2

(12) United States Patent
Kawaguchi

(10) Patent No.: US 8,698,861 B2
(45) Date of Patent: Apr. 15, 2014

(54) COLOR ERASING APPARATUS AND COLOR ERASING HEAT SOURCE UNIT

(71) Applicant: Toshiba Tec Kabushiki Kaisha, Tokyo (JP)

(72) Inventor: Takahiro Kawaguchi, Shizuoka (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/858,860

(22) Filed: Apr. 8, 2013

(65) Prior Publication Data

US 2013/0267412 A1 Oct. 10, 2013

Related U.S. Application Data

(60) Provisional application No. 61/622,429, filed on Apr. 10, 2012.

(51) Int. Cl.
*B41J 29/16* (2006.01)

(52) U.S. Cl.
USPC ..... 347/179

(58) Field of Classification Search
USPC ..... 347/171, 179
See application file for complete search history.

(56) References Cited

U.S. PATENT DOCUMENTS

| | | | | |
|---|---|---|---|---|
| 8,456,497 | B2 * | 6/2013 | Iguchi et al. | 347/179 |
| 2010/0315475 | A1 * | 12/2010 | Taki et al. | 347/179 |
| 2011/0221852 | A1 * | 9/2011 | Yahata et al. | 347/179 |
| 2012/0038732 | A1 * | 2/2012 | Iguchi et al. | 347/179 |

FOREIGN PATENT DOCUMENTS

| | | | |
|---|---|---|---|
| JP | 6-171226 | * 12/1992 | B41M 5/26 |
| JP | 05-165366 | 7/1993 | |
| JP | 11-133836 | 5/1999 | |

OTHER PUBLICATIONS

U.S. Appl. No. 13/528,542, filed Jun. 20, 2012, Kikuo Mizutani et al., 29 pages.

* cited by examiner

*Primary Examiner* — Kristal Feggins
(74) *Attorney, Agent, or Firm* — Patterson & Sheridan, L.L.P.

(57) ABSTRACT

According to one embodiment, a transporting path transports a paper with a heat erasable image. A first color erasing unit has a first heat roller and a first press roller. A second color erasing unit, downstream of the first color erasing unit, has a second heat roller and a second press roller. A gear drive train, engages the first heat roller and the second heat roller. An opening and closing mechanism moves between an open and a closed position. While maintaining the state of the gear drive train, the open position has the first press roller separated from the first heat roller and the second press roller separated from the second heat roller. In the closed position, the first press roller is in close proximity to the first heat roller and the second press roller is in close proximity to the second heat roller.

16 Claims, 5 Drawing Sheets

COLOR ERASING APPARATUS AND COLOR ERASING HEAT SOURCE UNIT

CROSS-REFERENCE TO RELATED APPLICATION

This application is based upon and claims the benefit of priority from U.S. provisional Patent Application No. 61/622,429, filed Apr. 10, 2012; the entire contents of which are incorporated herein by reference.

FIELD

The embodiments described herein relate generally to a color erasing apparatus and a color erasing heat source unit.

BACKGROUND

In an image forming apparatus, such as an MFP (a Multi-Function Peripheral), an image is formed on a sheet recording medium such as paper or the like (hereinafter will be referred to as "paper"). In order to erase the image formed on the paper and reuse the paper, the image is printed on the paper using an erasable coloring material such as ink containing a leuco dye. The erasable coloring material is erased by applying heat thereto at a high temperature.

The color erasing apparatus is configured to have a heat roller, into which a roller type heat source is built-in similar to a fuser (fixing) unit, and a press roller with an interposing paper transporting path. The heat roller and the press roller are arranged to face each other. The color erasing apparatus transports the printed paper by rotating the heat roller (the heat source) along with the press roller with the paper pinched therebetween. The image that had been formed on the paper is erased by heating the printed paper as it rolls moves between the press roller and a heat roller.

However, the printed paper being transported to the heat source (the color erasing unit) of the color erasing apparatus has been used at least once. Unlike new paper, the printed (used) paper may be guided to the color erasing unit in a deformed state, such as being wrinkled, folded, having a hole therein, or the like. The color erasing is achieved by heating the toner on the surface of the transported paper. The surface of the used paper is rapidly heated as it passes through the color erasing unit, vaporizing the moisture in the paper, and causing a subtle change in the size of the paper. Further wrinkling of the paper may occur when the used paper is heated and pressed by the rollers while passing through the color erasing unit. Therefore, transporting the paper becomes extremely unstable and paper jamming may occur.

The probability of a paper jam increases for used paper transported while applying roller pressure and heat. When a paper jam occurs at the color erasing unit, the paper is freed by releasing the pressure from the press roller or by turning a knob connected to the press roller for rotating it to release the jammed paper therefrom.

DETAILED DESCRIPTION

According to an embodiment of a color erasing apparatus, paper with an image formed by a coloring material which is erasable by heating thereof, is transported on a transporting path. A first color erasing unit includes a first heat roller, with a first heat source therein, and a first press roller, facing the first heat roller. The paper is sandwiched between the first heat roller and the first press roller during transport. The first color erasing unit is provided in the upstream side of the transporting path for erasing a first side of the paper. A second color erasing unit includes a second heat roller, with a second heat source therein, and a second press roller, facing the second heating member. The paper is sandwiched between the second heat roller and the second press roller during transport. The second color erasing unit is provided downstream of the first color erasing unit for erasing a second side of the paper. A gear drive train connects the first heat roller with the second heat roller, and includes a plurality of gears transmitting a driving force from a transporting motor to the first heat roller and the second heat roller. An opening and closing mechanism for the heat source moves from a first position to a second position while maintaining the connected state of the drive train gears coupled to the rotating axis of any one of the heat source rollers. The first heat roller is separated (spaced) from the first press roller and the second heat roller is separated (spaced) from the second press roller, in a first position. The first press roller is in close proximity to the first heat roller and the second press roller is in close proximity to the second heat roller in the second position.

The embodiments will be described below with reference to the drawings. Identical reference numbers have been used, where possible, to designate identical elements or locations that are common to the figures.

Figure 1:
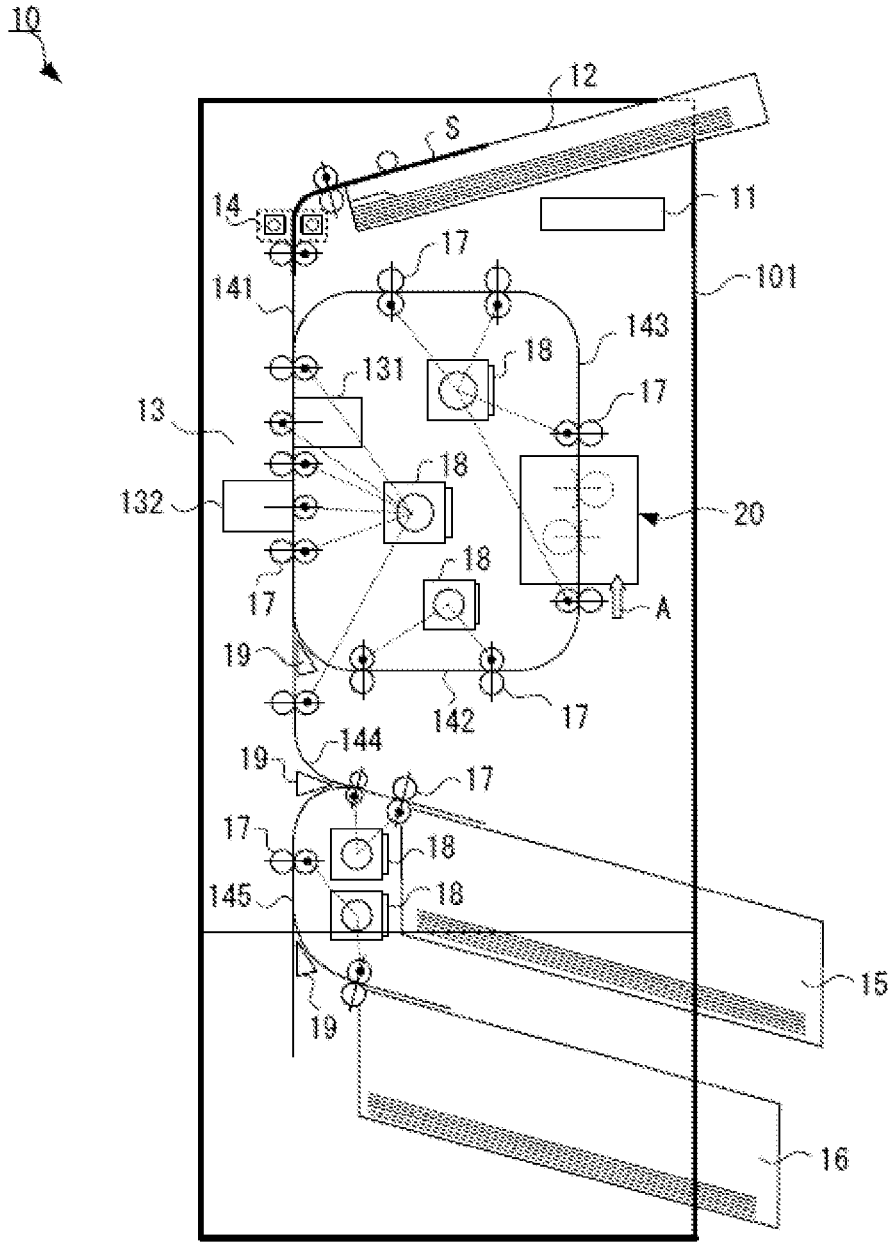
FIG. 1 is a diagram showing an example of the color erasing apparatus according to a first embodiment.
Figure 2:
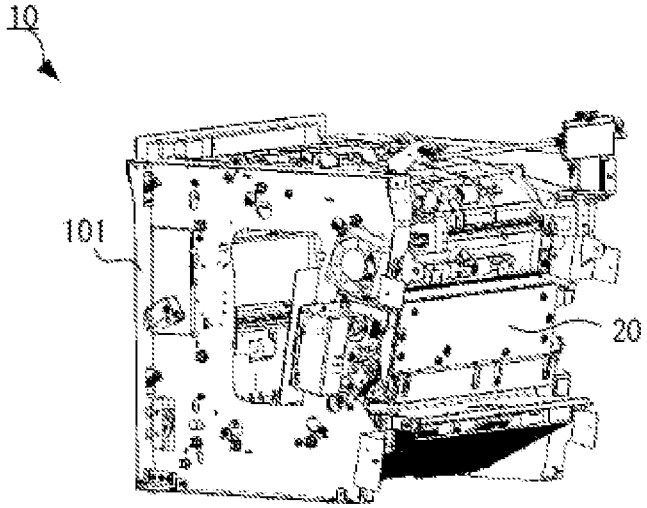
FIG. 2 is a perspective view showing an exterior of a paper transporting frame and a color erasing unit of the color erasing apparatus, according to an embodiment.

FIG. 1 is a schematic side view of a color erasing apparatus (multi function peripheral) illustrating the paper path and paper loading and storage paths according to one embodiment. FIG. 2 is a perspective view of the exterior of a paper transporting frame 101 and a color erasing unit 20 of the color erasing apparatus 10.

Referring to FIG. 1, the color erasing apparatus 10 includes a control panel 11 with operating buttons and a display unit, a paper feed unit 12, a scanner 13 that serves as a reading unit, an ultrasonic sensor 14 for detecting the conveyance state of the paper, and the color erasing unit 20 for erasing an image on the paper. The color erasing apparatus 10 has a paper discharging section with a first paper discharge tray 15 and a second paper discharge tray (the reject box) 16. Furthermore, the color erasing apparatus 10 includes a first transporting path 141, a second transporting path 142, a third transporting path 143, a fourth transporting path 144 and a fifth transporting path 145.

The transporting paths 141 to 145 have a plurality of motors 18 for driving a plurality of conveyor rollers 17 to transport a paper S therethrough. Furthermore, a plurality of gates 19 is provided for accurately transporting the paper S along each of the transporting paths 141 to 145.

The first transporting path 141 transports the paper S from the paper feed unit 12 to the scanner 13. The second transporting path 142 transports the paper S in the direction shown by arrow A from the scanner 13 to the color erasing unit 20. The third transporting path 143 transports the paper S from the color erasing unit 20 back to the scanner 13. The fourth transporting path 144 transports the paper S from the scanner 13 to the first paper discharge tray 15, and the fifth transporting path 145 transports the paper S from the scanner 13 to the second paper discharge tray (the reject box) 16.

The first paper discharge tray 15 accommodates the paper S which can be reused after an image has been erased. The second paper discharge tray (the reject box) 16 accommodates the paper S that cannot be reused and normally would be discarded and recycled.

The color erasing apparatus 10 carries out the following operations:

(1) The paper S supplied from the paper feed unit 12 along the first transporting path 141 is read by the scanner 13. The scanner 13 has a first scanner 131 and a second scanner 132 for reading both sides of the paper. The scanner 13 reads image data from a paper S to determine a printed status of both sides of the paper S. The image data read by the scanner 13 is saved.

(2) Torn or wrinkled paper S, as categorized by the image data, is guided along the fifth transporting path 145 to the reject box 16. The paper S, without tears or wrinkles, is transported along the second transporting path 142 to the color erasing unit 20.

(3) The paper S transported to the color erasing unit 20 is heated while passing through the color erasing unit 20. The color erasing unit 20 thereby erases the image on the paper, formed by an erasable color material, by applying heat and pressure to the paper at a relatively high temperature, for example, 180 to 200° C. A structure for the color erasing unit 20 will be described later herein.

(4) After passing through the color erasing unit 20, the paper is transported along the third transporting path 143 back to the scanner 13. The scanner 13 re-reads the printing status to confirm whether the image, formed by an erasable coloring material, has been erased by the color erasing unit 20.

(5) The paper S, determined to be free of an image, and that can be reused, is transported along fourth transporting path 144 to the first paper discharge tray 15. Paper S containing a residual image, or paper S containing tears or wrinkles, is transported along the fifth transporting path 145 to the reject box 16.

Figure 3A:
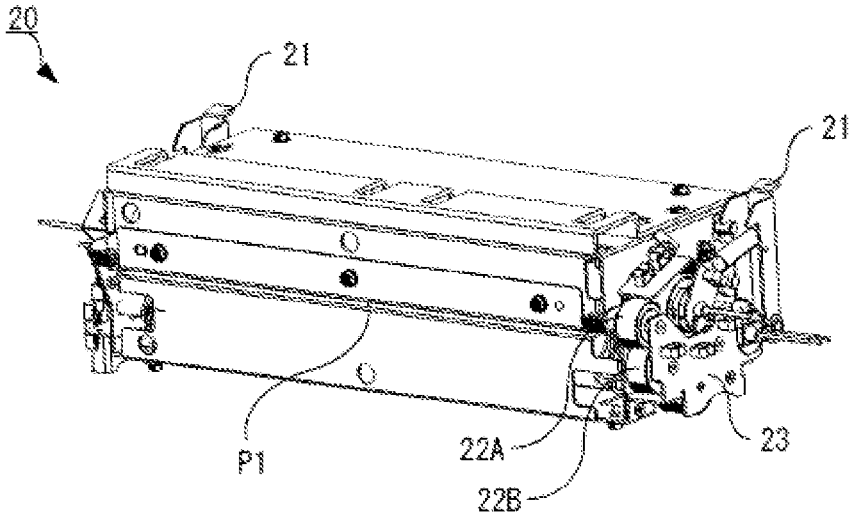
FIG. 3A is a perspective view showing the exterior of the color erasing unit, according to an embodiment.
Figure 3B:
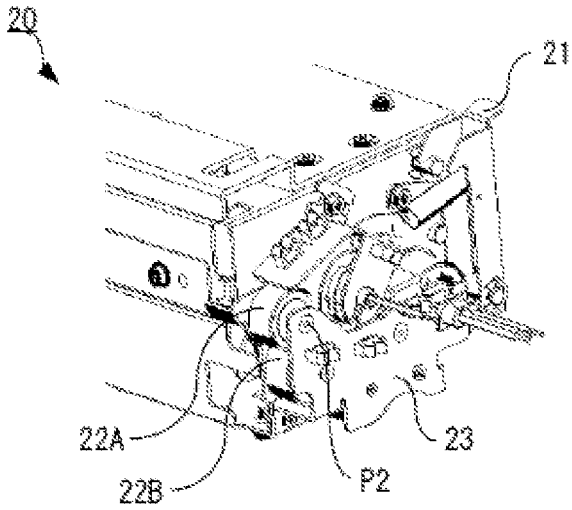
FIG. 3B is an enlarged view of a gear drive train of the color erasing unit, according to an embodiment.

FIG. 3A illustrates a perspective view showing the exterior of the color erasing unit 20. FIG. 3B is an enlarged view of the gear drive train for the color erasing unit 20. In one embodiment, the gear drive train refers to the drive gears and the driven gears together. A lever 21 is provided on a top surface of the color erasing unit 20 for opening and closing the heat source at the time of, or occurrence of, a paper jam. Furthermore, the gear drive train, having a plurality of gears 22A and 22B, is provided inside of a gear bracket 23 on the side surface of the color erasing unit 20. The gear drive train drives the heat rollers 213 and 214 as well as the press rollers 301 and 302. The gears that comprise the gear drive train include a drive gear connected to the transporting motor (not shown). The transporting motor provides power to the gear drive which transmits the driving power to the other connected gears, rotating the heat rollers 213 and 214 and the press rollers 301 and 302. An entrance in a guide rail, denoted by notation P1, is provided for guiding the paper to the heat source. Color erasing unit 20, shown in FIG. 3A and FIG. 3B, can be removed by the user from the main body of the color erasing apparatus 10. Advantageously, by making the color erasing unit 20 removable, the paper can be taken out easily during a paper jam, and the appropriate maintenance task can be carried out easily.

Figure 4:
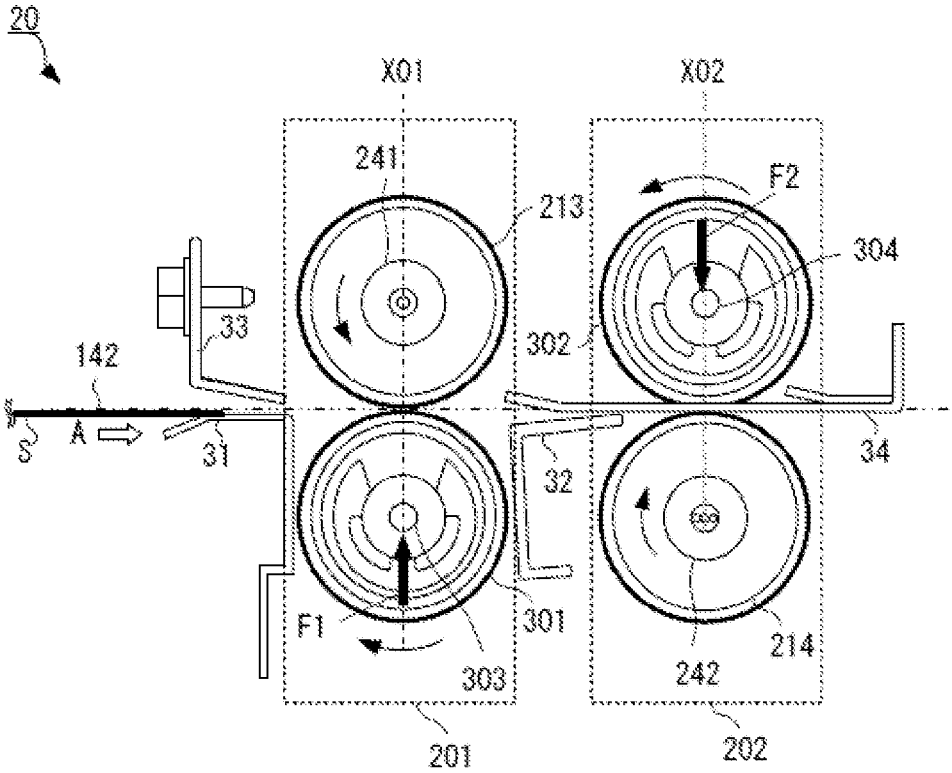
FIG. 4 is a cross-sectional view showing an inner structure of the color erasing unit, according to an embodiment.

FIG. 4 is an example illustration of a side view for the inside structure of the color erasing unit 20. The color erasing unit 20 transports the paper S while erasing the image on the paper S by exposing the paper to a heat source having a prescribed temperature setting. As shown, the color erasing unit 20 has a first color erasing unit 201 and a second color erasing unit 202. The first color erasing unit 201 includes the heat roller 213 and the press roller 301. The second color erasing unit 202 includes the heat roller 214 and the press roller 302. Furthermore, the first color erasing unit 201 and the second color erasing unit 202 are inverted from each other across the paper S path therethrough. Heat roller 213 is on the top surface and heat roller 214 is on the bottom surface of the intermediary paper S. Press roller 301 and press roller 302 rotate around rotating axes 303 and 304, respectively. The rollers are of a cylindrical shape extending in the width direction of the paper S.

The paper S is transported along the second transporting path 142 in the direction of arrow A. The direction of arrow A is equivalent to the direction of arrow A in FIG. 1. The heat rollers 213 and 214 have cylindrically shaped halogen heaters 241 and 242, respectively. The first color erasing unit 201 has a guide plate 31 installed on the side surface of the paper entry side, and a guide plate 32 installed on the side surface of the paper exit side. The guide plate 31, along with a guide plate 33, guides the entry of paper S. The guide plate 33 is secured inside of the color erasing unit 20, facing the guide plate 31. The guide plate 32, along with a guide plate 34, guides the exit of paper S. The guide plate 34 is secured inside of the color erasing unit 20, facing the guide plate 32. The guide plates 32 and 34 become the guides for entering the paper S into the second color erasing unit 202.

The press rollers 301 and 302 are cylindrically shaped rotating rollers and rotate about axis 303 and 304. The press rollers 301 and 302 contact heat rollers 213 and 214 in the longitudinal direction thereof. The paper S is transported while being heated by biasing the rotating axis 303 and 304 (or the rollers 301, 302) in the direction of the heat rollers 213 and 214, sandwiching the paper S between the heat roller 213 and the press roller 301, as well as between the heat roller 214 and the press roller 302 as the paper S passes therethrough.

F1 denotes a biasing pressure (pinch pressure) of the press roller 301 in the direction of the heat roller 213, in the first color erasing unit 201. F2 denotes a biasing pressure (pinch pressure) of the press roller 302 in the direction of the heat roller 214, in the second color erasing unit 202. In one embodiment, the ratio of the pinch pressure F1 to the pinch pressure F2 is 3:2.

The rotating axis 303 is configured to bias, by use of a spring, press roller 301 towards the heat roller 213 in order to apply the pinch pressure F1. Furthermore, the rotating axis 304 is configured to bias, by use of a spring, press roller 302 towards the heat roller 214 in order to apply the pinch pressure F2.

Next, the color erasing operation for the paper S by the heat rollers 213 and 214 and the press rollers 301 and 302 will be explained. The paper S is guided via the second transporting path 142 through the guide plates 31 and 33 into the color erasing apparatus 20. Paper S is transported through the color erasing apparatus 20 in the direction of arrow A, at a speed set in advance, by rotating clockwise the press roller 301 of the first color erasing unit 201 while rotating counterclockwise the press roller 302 of the second color erasing unit 202.

In the first color erasing unit 201, which is situated upstream in the transporting path, the press roller 301 is biased to be in contact with the heat roller 213 by the pinch pressure F1. A nip area for applying heat to the paper S is created at the contact point (the dashed line X01) of the press roller 301 and the heat roller 213. When paper S passes through the nip area X01, the surface of the paper is heated to erase the image formed on a first surface of the paper S.

When an image has been formed on the paper S using an erasable coloring material, the coloring material can be erased by heating the erasable coloring material at a predetermined temperature. The heat roller 213 is provided with a uniform heat by the cylindrically shaped halogen heat lamp 241 and is maintained thereby at the erasable temperature. The temperature of the heat roller 213 is detected by thermistors (not shown) and maintained at the appropriate temperature based on the detected temperature.

The paper S, discharged from the first color erasing unit 201, is guided by guide plates 32 and 34 and transported into the second color erasing unit 202. In the second color erasing unit 202, downstream on the transporting path from first color erasing unit 201, the relationship between the upper position for the press roller 302 and lower position for the heat roller 214 is reversed from that in the first color erasing unit 201. Additionally, press roller 302 is biased to be in contact with the heat roller 214 by pinch pressure F2.

The contact point of the press roller 302 and the heat roller 214 forms the nip area from which the heat is applied to paper S. The surface of the paper is heated by passing the paper through the nip area to erase the image formed on the second surface of the paper S. The paper S, in which both surfaces have been erased, is discharged from guide plate 34 and sent along third transporting path 143.

The first color erasing unit 201 and the second color erasing unit 202 are structurally the same; however the units are arranged with the heat roller and press roller in opposing locations with respect to the paper S path. The opposing locations for the heat rollers enable erasing an image on the first side of the paper S with the first color erasing unit 201 and an image on the second side of the paper S with the second color erasing unit 202. Therefore, the images on both sides of the paper S can be erased efficiently.

However, a paper jam may occur when the paper passes through the inside of the color erasing unit 20 with a structure of twin or two different color erasing units as described above. The color erasing unit 10 heats printed or previously used paper while an image forming apparatus may print on virgin paper. Therefore, the color erasing unit 10 has a higher probability of a jamming paper than an image forming apparatus. The following section will describe a heat source opening and closing mechanism provided to address this problem in the color erasing apparatus 10.

Figure 5A:
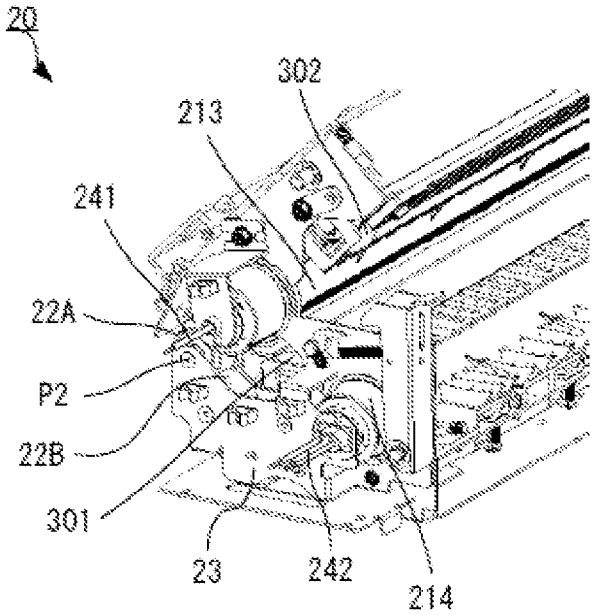
FIG. 5A and FIG. 5B are perspective views showing a release state of a heat source opening and closing mechanism of the color erasing unit, according to an embodiment.
Figure 5B:
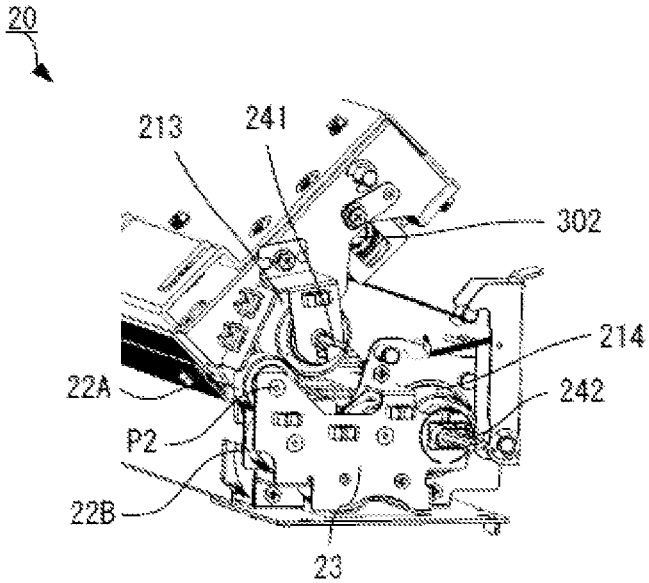

FIGS. 5A and 5B illustrate perspective views for the heat source opening and closing mechanism in an open state for the color erasing unit 20. When a user releases a lock of the lever 21 (FIG. 3B), the heat source opening and closing mechanism, released in the color erasing unit 20, rotates about axis P2 of gear 22A, provided in the upper portion of the gear drive train. The heat roller 213 and the press roller 302 are included in the upper portion of the unit. In addition to the press roller 301 and the heat roller 214, gear 22A and the plurality of gears (gears 22B, 22C, and 22D that will be mentioned later) connected sequentially to gear 22A, are included in the lower portion of the unit. The heat source opening and closing mechanism of the color erasing unit 20 releases the second color erasing unit 202, located downstream in the paper transporting direction, earlier than the first color erasing unit 201. The paper passing through the first color erasing unit 201 may become curled along the shape of the heat roller 213. Therefore, the occurrence of a paper jam due to the curled paper is increased when the paper, curled after passing through the first color erasing unit 201, proceeds to the second color erasing unit 202. In contrast, when the paper has passed through the second color erasing unit 202, after passing the first color erasing unit 201, the jammed paper is outside the color erasing unit 20 and can be removed easily.

Figure 6A:
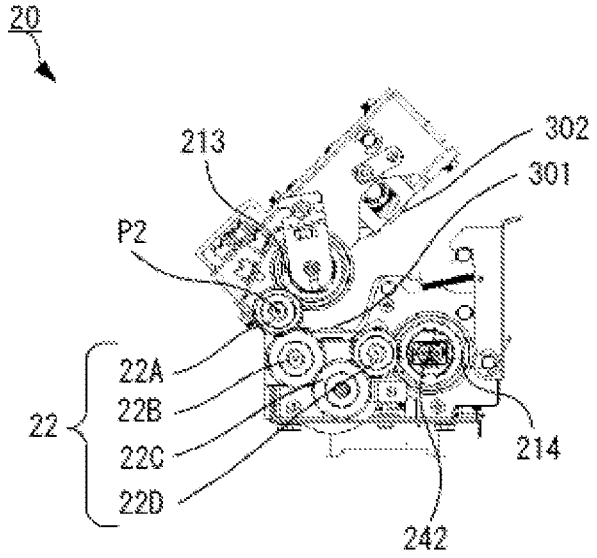
FIG. 6A is a side view showing the release state of the heat source opening and closing mechanism of the color erasing unit, according to an embodiment.
Figure 6B:
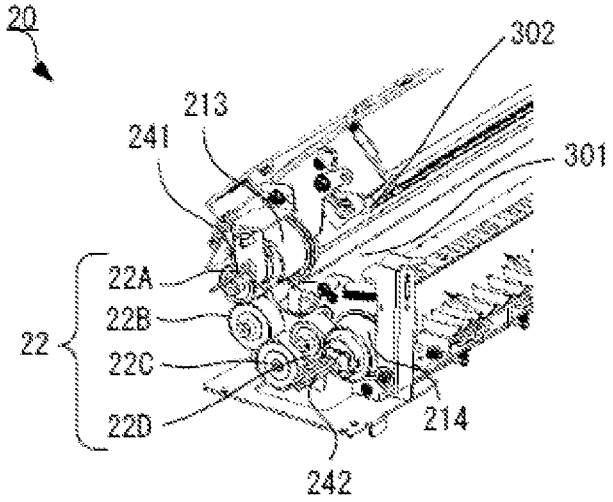
FIG. 6B is a perspective view showing the release state of the heat source opening and closing mechanism of the color erasing unit, according to an embodiment.

FIG. 6A and FIG. 6B illustrate a side view and a perspective view, respectively, for the heat source opening and closing mechanism in an open state for the color erasing unit 20.

As has been explained above, the heat source opening and closing mechanism is divided into an upper and a lower unit that have been integrated into a single body. The upper unit has the heat roller 213 of the first color erasing unit 201 and the press roller 302 of the second color erasing unit 202. The lower unit has the heat roller 214 of the second color erasing unit 202, the press roller 301 of the first color erasing unit 201, and the gear drive train 22.

In the upper unit, the heat roller 213 of the first color erasing unit 201 is arranged adjacent to gear 22A and arranged in the downstream side of the paper transporting direction from gear 22A arranged at the beginning of gear drive train 22. The press roller 302 of the second color erasing unit 202, facing heat roller 214, is arranged in the downstream side of the paper transporting direction from heat roller 213.

In the lower unit, the press roller 301, of the first color erasing unit 201, is adjacent to the gear 22A and arranged in the downstream side of the paper transporting direction from gear 22A. A gear 22B is connected to a lower portion of gear 22A and arranged in the downstream side of the paper transporting direction from gear 22A. Similarly, gear 22C is connected to a lower portion of gear 22B and arranged in the downstream side of the paper transporting direction from gear 22B. Gear 22D is connected in the upper portion of gear 22C and is arranged in the downstream side of the paper transporting direction from gear 22C. Gear 22D is adjacent to heat roller 214, in second color erasing unit 202, and arranged in the downstream side of the paper transporting direction from gear 22D.

That is to say, the gear drive train arranged inside of the gear bracket 23 has a gear structure that sequentially connects gears 22B, 22C, and 22D with gear 22A. Gear 22A serves as the head gear and is connected to heat roller 213 of the first color erasing unit 201. Heat roller 214, of the second color erasing unit 202, is connected to gear 22D, arranged as the last gear. The amount of clearance between mated gear teeth is controlled for backlash.

As shown in FIG. 6A and FIG. 6B, the heat source opening and closing mechanism rotates until the open position at which time press roller 301 (first press roller) is separated from heat roller 213 (first heat roller) and press roller 302 (second press roller) is separated from heat roller 214 (second heat roller), respectively. In contrast to this, as shown in FIG. 3A and FIG. 3B, when the heat source opening and closing mechanism is in a closed position, press roller 301 is in close proximity to heat roller 213 and press roller 302 is in close proximity to heat roller 214. When the heat source opening and closing mechanism is in a closed state, the heat rollers 213 and 214 and the press rollers 301 and 302 rotate by engaging with the drive of gears 22A through 22D, so that the paper can be transported.

When a paper jam occurs, the jammed paper is taken out by releasing the heat source (heat rollers 213 and 214) from the press rollers 301 and 302. When the heat source is closed again, the heat source opening and closing mechanism maintains the gear coupling for the gear drive train 22. For this reason, backlash control among the gears that constitute the gear drive train 22 is unnecessary. Furthermore, a quit high conveyance speed can be achieved by maintaining the gear coupling for the gear drive train 22. Color erasing unit 20, which is the color erasing heat source, can achieve high rigidity since the color erasing unit has a structure that maintains the gear coupling for the gear drive train 22, which drives heat rollers 213 and 214, even when opening the heat source by supporting the gear drive train 22. In the embodiment described above, the color erasing unit 20 is configured as a dual unit structure for efficiently erasing the color from both sides of the paper. However, the same release structure can also be applied to a single-unit structure. The embodiment also described a structure for opening around a rotating axis of gear 22A, connected to the heat roller 213 of the first color erasing unit 201. However, the structure may also swing open around the rotating axis of other gears that constitute the gear drive train. Furthermore, described is an example in which the gear drive train 22 is formed by four gears; however, the gear drive train may also be a structure of coupling an even number of gears such as two or six gears. The number and size of the gear can be designed and modified arbitrarily depending on the size of the gear combined or the size of the apparatus.

While certain embodiments have been described, these embodiments have been presented by way of example only, and they are not intended to limit the scope of the invention. Indeed, the novel embodiments described herein may be embodied in a variety of other forms. Furthermore, various omissions, substitutions and changes in the form of the embodiments described herein may be made without departing from the spirit of the inventions. The accompanying claims and their equivalents are intended to cover such forms or modifications as would fall within the scope and spirit of the invention.

What is claimed is:

1. A color erasing apparatus, comprising:

a transporting path for transporting a paper with a heat erasable image;

a first color erasing unit having a first heat roller, with a first heat source therein, and a first press roller facing the first heat roller;

a second color erasing unit having a second heat roller, with a second heat source therein, and a second press roller facing the second heat roller;

a gear drive train connecting the first heat roller with the second heat roller, wherein the gear drive train has a plurality of gears; and a heat source opening and closing mechanism moveable from a first position to a second position while maintaining the state of the gear drive train, wherein the first press roller is separated from the first heat roller and the second press roller is separated from the second heat roller while in the first position, and the first press roller is in close proximity to the first heat roller and the second press roller is in close proximity to the second heat roller while in the second position.

2. The color erasing apparatus according to claim 1, wherein the first color erasing unit, the second color erasing unit, the gear drive train, and the heat source opening and closing mechanism are formed inside of a color erasing heat source unit removable from the color erasing apparatus.

3. The color erasing apparatus according to claim 1, wherein the heat source opening and closing mechanism swings about a rotation axis of the gears connected to the first heat roller while maintaining the coupling state of the gear drive train.

4. The color erasing apparatus according to claim 1, wherein the gear drive train is comprised of an even number of gears.

5. The color erasing apparatus according to claim 4, wherein the heat source opening and closing mechanism rotates, to the first position from the second position, around a rotation axis of the gear provided most upstream in the transporting path of the paper.

6. A color erasing heat source unit, comprising:

a first color erasing unit having a first heat roller and a first press roller facing the first heat roller;

a second color erasing unit having a second heat roller and the second press roller facing the second heat roller;

a gear drive train, coupling together the first heat roller and the second heat roller, having a plurality of gears for transmitting a driving force of a transporting motor to the first heat roller and the second heat roller; and a heat source opening and closing mechanism that moves to a first position from a second position while maintaining a coupled state for the gears in the gear drive train, wherein the first heat roller is separated from the first press roller and the second heat roller is separated from the second press roller in the first position, and the first press roller is in close proximity to the first heat roller and the second press roller is in close proximity to the second heat roller while in the second position.

7. The color erasing heat source unit according to claim 6, wherein the heat source opening and closing mechanism is moveable, while maintaining the coupling state of the gear drive train, about a rotation axis of the gear connected to the first heat roller.

8. The color erasing heat source unit according to claim 6, wherein the gear drive train is composed of an even number of gears.

9. The color erasing heat source unit according to claim 8, wherein the heat source opening and closing mechanism swings about the center of a rotation axis, for the gear provided most upstream in the transporting direction of the paper, to the first position and to the second position.

10. The color erasing heat source unit according to claim 6, wherein the first color erasing unit, the second color erasing unit, the gear drive train, and the heat source opening and closing mechanism are formed inside of a color erasing heat source unit removable from the color erasing apparatus.

11. A method for accessing a paper jammed in a color erasing heat source unit, the method comprising:

receiving a paper transported along a transportation path into a first color erasing unit, wherein the first color erasing unit has a first heat roller and a first press roller in close proximity;

transporting and heating the paper through the first color erasing unit by rotating the first heat roller and the first press roller together, wherein the first heat roller and the first press are coupled together by a gear drive train;

receiving the paper into a second color erasing unit having a second heat roller and a second press roller, wherein the second heat roller and second press roller is rotated together by the gear drive train; and opening a heat source opening and closing mechanism, moveable from a first position to a second position while maintaining a coupled state for the gear drive train, wherein the first press roller is in close proximity to the first heat roller and the second press roller is in close proximity to the second heat roller in the first position and the first heat roller is separated from the first press roller and the second heat roller is separated from the second press roller in the second position.

12. The method of claim 11 wherein opening the heat source opening and closing mechanism further comprises:

swinging the heat source opening and closing mechanism about the center of a rotation axis for a gear in the gear drive train to the first position and to the second position.

13. The method of claim 12 wherein, the gear drive train is composed of an even number of gears.

14. The method of claim 13 wherein the gear is the most upstream in the transporting direction of the paper for the gear drive train.

15. The method of claim 13 wherein, the heat source opening and closing mechanism swings about the rotation axis of a gear connected to the first heat roller while maintaining the coupled state of the gear drive train.

16. The method of claim 13 wherein, the first color erasing unit, the second color erasing unit, the gear drive train, and the heat source opening and closing mechanism are formed inside of a color erasing heat source unit removable from the color erasing apparatus.

* * * * *